US005704889A

United States Patent [19]

Hlavinka et al.

[11] Patent Number: 5,704,889

[45] Date of Patent: Jan. 6, 1998

[54] SPILLOVER COLLECTION OF SPARSE COMPONENTS SUCH AS MONONUCLEAR CELLS IN A CENTRIFUGE APPARATUS

[75] Inventors: Dennis Hlavinka, Golden; Thomas J. Felt, Boulder, both of Colo.

[73] Assignee: Cobe Laboratories, Inc., Lakewood, Colo.

[21] Appl. No.: 422,598

[22] Filed: Apr. 14, 1995

[51] Int. Cl.[6] ..... B04B 11/04

[52] U.S. Cl. ..... 494/37; 494/45

[58] Field of Search ..... 494/1, 18, 21, 494/37, 45; 604/4–6; 210/781, 782

[56] References Cited

U.S. PATENT DOCUMENTS

| | | | |
|---|---|---|---|
| 1,723,212 | 8/1929 | Sheeran . | |
| 3,452,924 | 7/1969 | Schultz . | |
| 3,655,123 | 4/1972 | Judson et al. . | |
| 3,708,110 | 1/1973 | Unger et al. . | |
| 3,737,096 | 6/1973 | Jones et al. . | |
| 3,858,795 | 1/1975 | Joyce . | |
| 3,858,796 | 1/1975 | Unger et al. . | |
| 4,007,871 | 2/1977 | Jones et al. . | |
| 4,010,894 | 3/1977 | Kellogg et al. . | |
| 4,091,989 | 5/1978 | Schultz . | |
| 4,094,461 | 6/1978 | Kellogg et al. . | |
| 4,120,448 | 10/1978 | Cullis . | |
| 4,151,844 | 5/1979 | Cullis et al. . | |
| 4,187,979 | 2/1980 | Cullis et al. . | |
| 4,316,576 | 2/1982 | Cullis et al. . | |
| 4,330,080 | 5/1982 | Mathieu . | |
| 4,356,958 | 11/1982 | Kolobow et al. . | |
| 4,386,730 | 6/1983 | Mulzet . | |
| 4,387,848 | 6/1983 | Kellogg et al. . | |
| 4,430,072 | 2/1984 | Kellogg et al. . | |
| 4,447,221 | 5/1984 | Mulzet . | |
| 4,531,932 | 7/1985 | Luppi et al. | 494/18 X |
| 4,557,719 | 12/1985 | Neumann et al. . | |
| 4,636,193 | 1/1987 | Cullis | 494/45 |

FOREIGN PATENT DOCUMENTS

| | | |
|---|---|---|
| WO 93/12805 | 7/1993 | WIPO . |
| WO 94/08691 | 4/1994 | WIPO . |

OTHER PUBLICATIONS

A.L. Jones, "Blood Cell Washing," *IBM Technical Disclosure Bulletin*, vol. 10 No. 7, Dec. 1967, pp. 944–945.

Fresenius MT AS 104 blood cell separator, Apr. 6, 1990(OP), Operating Instructions, Chapter 2.

Gebrauchsanweisung, Kapitel 2, Fresenius MT Blutzellseparator AS 104, Jul. 3, 1992(GA); English translation Part 12.3.7.9, "Cycle Control and Spillover Parameters," Software version 4.6.

*Operator's Manual*, 7–19–3–185, Fenwal® CS–3000® Plus Blood Cell Separator, Oct. 1990.

*Owner's Operating and Maintenance Manual*, Haemonetics Mobile Collection System, Dec. 1, 1991, Rev.B., Part No. 35349, Haemonetics Corporation, Braintree, MA 02184.

*Primary Examiner*—Charles E. Cooley
*Attorney, Agent, or Firm*—Charles E. Rohrer

[57] ABSTRACT

A centrifuge apparatus is used for collecting white blood cells (WBC), primarily mononuclear cells, from whole blood stratified into layers. A thin mononuclear (MNC) layer is formed at the interface of red blood cells and plasma. A barrier is positioned in the separation vessel of the centrifuge at a location to intercept the thin layer. MNC fluid is allowed to pool behind the barrier before collection is started. To collect the MNC pool, the stratified red blood cell layer is raised from below the interface level by slowing or reversing flow in the RBC exit line thereby causing the MNC pool to spill over the barrier into a well in which a collect line is positioned. Collection ceases when a desired percentage of the pool is removed and the normal position of the interface is re-established; thereafter the pool builds again. By raising the MNC pool from below, improvements in purity in and collect volume are achieved. The collection procedure can be useful for harvesting granulocytes and, in general, any sparse stratified component of a centrifuged solution where the sparse component is layered between more dense and less dense strata.

(List continued on next page.)

15 Claims, 4 Drawing Sheets

U.S. PATENT DOCUMENTS 4,647,279 3/1987 Mulzet et al. .
4,668,214 5/1987 Reeder .
4,708,712 11/1987 Mulzet .
4,807,676 2/1989 Cerny et al. .
4,838,852 6/1989 Edelson et al. .
4,850,995 7/1989 Tie et al. .
4,934,995 6/1990 Cullis .
4,940,543 7/1990 Brown et al. .
5,006,103 4/1991 Bacehowski et al. .
5,104,526 4/1992 Brown et al. .
5,141,486 8/1992 Antwiler .
5,224,921 7/1993 Dennehey et al. .
5,260,598 11/1993 Brass et al. .
5,281,342 1/1994 Biesel et al. .
5,322,620 6/1994 Brown et al. .

SPILLOVER COLLECTION OF SPARSE COMPONENTS SUCH AS MONONUCLEAR CELLS IN A CENTRIFUGE APPARATUS

This invention relates to a system for the centrifugal processing of liquids such as whole blood and, more particularly, to improvements in the collection of species which are sparse within a liquid such as the mononuclear cell component of whole blood.

BACKGROUND OF THE INVENTION

Centrifugation is a technique used to process whole blood in order to separate the blood into its various components. To reduce personal contact with blood products and reduce cross-contamination between different blood sources, the centrifugal apparatus can be fitted with a disposable plastic vessel through which the blood is circulated. The vessel is fitted into a centrifuge fixture that is driven by a motor. An exemplary vessel is a circumferential separation channel having several outlets positioned at different radial positions within the channel in order to remove blood components which have been separated by the centrifuge into stratified layers of differing density. Red blood cells (RBC) being the most dense of the components are stratified within the channel at the most radially outward location whereas the stratified layer of plasma is the least dense component and therefore the most radially inward layer. A relatively thin layer called the buffy coat contains white blood cells and platelets and is located between the red blood cell layer and the plasma layer. Within the buffy coat the platelets are stratified toward the plasma while the white blood cells are stratified toward the red blood cells. Depending on centrifuge speed, platelets may also be dispersed within the plasma.

The disposable plastic vessel which is fitted into a rotating fixture within the centrifuge is connected to the blood source and to collection reservoirs through a disposable tubing set. In that manner, the centrifuge equipment itself is kept out of contact with blood and the disposable tubing set and separation channel are discarded after one procedure. The source of blood can be whole blood flowing directly from a donor or patient, or it can be previously donated bone marrow or blood.

Blood components may be collected from a patient, stored and perhaps frozen, and reinfused into the patient days or even years later. The mononuclear cell portion of white blood cells is sometimes collected, stored in the above manner, and reinfused into the patient for the treatment of diseases such as cancer. There are obvious advantages to returning blood components from the patient's own blood rather than using the blood of a donor. It is generally agreed that the safest blood a person can receive is his or her own blood (autologous blood). The use of autologous blood reduces the risk of exposure to transfusion transmitted disease and febrile/allergic transfusion reactions. To accomplish the collection of white blood cells (WBC), an apheresis system has been developed for harvesting them from the buffy coat. In particular, the mononuclear cell (MNC) portion of WBCs are harvested including lymphocytes, monocytes, progenitor cells, and stem cells. In this document the designations WBCs and MNCs are usually used interchangeably. Efficient equipment for collecting MNCs is described in U.S. Pat. No. 4,647,279. However, even with efficient equipment, the collection of mononuclear cells is difficult since they make up only a small fraction of the total blood volume. For a patient of normal size with a normal MNC count, the total volume of MNCs may be about 1.5 milliliters, that is about 0.03% of the total blood volume. As a consequence, when whole blood is centrifuged, only a very thin MNC layer appears between the red blood cell and plasma layers.

The thin MNC layer presents a challenge when attempting an MNC harvest. Because the MNC fraction of whole blood is so small, the equipment referred to above includes a barrier positioned in the channel upstream of the RBC exit port. MNCs are accumulated at the barrier with a WBC collection port placed in front of the barrier. The fraction collected through the WBC collection port is actually a mixture of WBCs, platelets, plasma and RBCs. In collection procedures, the color of the collected fraction may be monitored in order to adjust the blood inflow and plasma outflow rates, if necessary, manually or automatically, to fine tune the position of the MNC layer so that the MNC layer corresponds in position with the WBC collection port. Usually, an operator makes very fine adjustments to the speed of the plasma pump in order to position the MNC layer properly for collection. If manual monitoring is used, the operator judges the position of the MNC layer according to the color of the fluid leaving the collection channel, and adjustments are made to provide the desired color in the collect port. If, for example, the operator begins to observe a reddish tint, the presence of RBCs are signified in the collect line. In such case, there is a need to increase the amount of plasma in the separation channel so that the RBC layer can be lowered. That can be accomplished by reducing plasma pump speed. Fine control is provided over the speed of the plasma pump such that adjustments may be made in collect volume on the order of one tenth milliliter per minute. Even though small changes are possible in the speed of the pump, it is not unusual for a change in plasma pump speed to over or under-correct, necessitating further change in pump speed. As a consequence, the interface positioning system, manual or automatic, can be involved in a vibratory chasing of the correct interface position with the result of decreased efficiency and purity in collecting the MNC layer. A further problem is that after each change in pump speed the process requires a period of time for the change to take effect, that is, for the new interface position to become established. Attempts have been made to use optical monitoring equipment to judge the opacity of the collect volume and automatically adjust plasma pump speed. However, such techniques designed to automate the system are also subject to oscillations around the control point and generally provide little improvement over the system when it is operated manually. Basically, all of these problems result from the fact that the target species is sparse and forms a very thin stratified layer which is difficult to harvest separately from other components, and because of the relatively low response of the interface to changes in the flow rate.

Because of the difficulty in properly positioning and maintaining the interface, a relatively wide band of volume is collected from the WBC port so that there is an assurance that the thin white blood cell layer has been collected. By collecting a wider band, however, a considerable amount of plasma, platelets, or red blood cells are also collected together with the white blood cells. Such a technique is efficient in the sense that it collects most of the stratified white cells, but it is low in purity. Also, the volume of collection is increased over what is needed. The goals of high MNC yield or efficiency and a low collection volume of high purity are somewhat mutually exclusive since it is difficult to extract only the thin stratified layer of white blood cells. Generally, volume and purity are sacrificed in favor of collection efficiency.

To further explain and illustrate, WBCs are comprised of mononuclear cells and polymorphonuclear cells (PMNs including granulocytes). Granulocytes are normally a small sub-population of WBCs in healthy people but grow to a more significant sub-population when the body reacts to disease. When whole blood is centrifuged, depending on centrifuge speed, the thin buffy coat layer is itself stratified into a still thinner layer of MNCs and a thin layer of platelets. The granulocytes are found in the buffy coat tending more toward the RBC layer and are also found in significant populations within the RBC layer. When the needs of a patient make it advisable to harvest granulocytes, a drug is generally provided to the patient which enables the granulocytes to migrate from the RBC layer into the buffy coat as a thin layer between the RBCs and the MNCs. In harvesting granulocytes, it has been necessary to also collect MNCs since the layers are too thin to be harvested separately. A substantial volume of RBCs and plasma are also collected in the procedure.

It is an object of the current invention to provide an improved collection procedure for harvesting sparse layers of stratified components in centrifuged liquids such as mononuclear cells in blood in order to collect a decreased volume with higher purity at high efficiency.

SUMMARY OF THE INVENTION

Briefly stated, the invention relates to the collection of species which are sparse within a liquid, such as mononuclear cells (MNCs) which form a thin stratified layer between red blood cells and plasma when whole blood is centrifuged. In this invention, a barrier is placed within the centrifuge separation channel at a location to intercept both the MNC and RBC layers. As blood is pumped through the separation channel, a pool of MNC fluid forms in front of the barrier and builds to a reservoir volume. Process flow parameters are then changed to allow the RBC layer to rise thereby lifting the MNC reservoir causing a spillover of MNC fluid over the barrier. The spillover flows into a well located in the separation channel downstream from the barrier. A collect line is positioned for removal of the MNC fluid from the well to a collect bag. Once begun, collection is continued long enough to remove the desired fractional volume of the MNC pool. If a cyclical operation is used, collection then ceases for a period long enough to reestablish the interface level behind the barrier and to rebuild the pool. Collection begins again, and the intermittent collection process of building and spilling the MNC reservoir continues until the volume of whole blood to be processed has been completed.

The collection procedure of the invention is also useful in collecting granulocytes and, in general, is useful for harvesting any stratified sparse species within a centrifuged liquid where the layer to be harvested forms between more dense and less dense strata.

In any MNC collection process, it is desirable to collect high purity MNC product that is, not contaminated with RBCs, PMNs or platelets. It is also desirable to be able to collect a variable MNC concentration to meet variable clinical requirements, that is, MNCs plus a desired amount of plasma. Further, it is desirable to minimize the time period for which a patient or donor is connected to the machine. The invention herein provides these significant advantages over previous collection equipment and procedures. The invention herein utilizes a particular separation channel geometry which has been used in the past for platelet collection, but provides significant benefits in harvesting MNCs. A key feature of the invention in obtaining purity of the collect volume of MNC's is raising the MNC reservoir to cause MNCs to spill past the top of the barrier by adding RBCs to the channel at a point well below the junction at which the MNCs float on the surface of RBCs. In that manner, the MNC reservoir remains undisturbed as it is raised. This feature is accomplished by reversing the flow in the RBC exit line and locating the exit port well below the MNC pool. Reversal of flow in the RBC exit line may be accomplished by slowing or stopping the inlet flow to the channel. Also, it is beneficial to locate the RBC exit port some significant distance from the MNC pool to further minimize disturbance of the pool and resultant RBC contamination.

To build a large, pure, MNC pool as rapidly as possible, the inlet port is located a significant distance from the barrier. In that manner, sufficient time for the centrifugal separation of the MNCs from the RBCs is provided as the inlet blood moves from the inlet port toward the barrier.

After spilling over the barrier, a well is provided in which to collect the MNCs while plasma continues to flow past the collect well to the plasma exit port. The provision of a well from which to collect MNCs adds to the purity of the collect volume and the provision of a separate plasma exit port from the collect exit port enables the adjustment of the collect and plasma pump speed ratio to alter collect concentration to a desired level.

A process accumulation volume is that amount of whole blood needed to build the desired MNC volume in front of the barrier. Process accumulation volume is a function of the MNC count, the inlet flow rate, the separation factor, and the geometry of the barrier and the channel. Separation factor is a function of centrifuge speed, blood flow rate, and the geometry of the separation channel.

In the collection procedure, process parameters are established according to input data from the patient or donor and the time required to build an accumulation volume is calculated. Also, spillover time or volume is established together with the desired collect concentration. The interface is established and an accumulation phase is entered to maintain a steady state interface and build a pool of MNCs at the barrier. When the pool is fully built, a spillover phase is entered to raise the interface level and cause the pool to spill over the barrier into the collect well from which it is removed through the collect line and collect pump to a reservoir. If the accumulation volume from one spillover is insufficient to meet requirements, the steady state interface can be reestablished and another cycle of accumulation and spillover entered. The procedure may be repeated as many times as necessary to collect the desired volume of MNCs.

During the accumulation phase, platelets and plasma flow past the barrier and platelets accumulate in the well. They are removed through the collect line by the collect pump and returned to the donor together with the plasma which is removed by the plasma pump. If desired, a portion of the platelets can be collected as well as a portion of the plasma. In that manner, MNCs are collected during the spillover phase and platelets are collected during the accumulation phase. Plasma may be collected during either phase.

The preferred technique for raising the interface during the spillover phase is to halt the inlet flow into the channel. Plasma and collect pump speed ratios may be altered to achieve the desired collect concentrations. When the desired spill volume is reached, a return is made to the accumulation phase inlet flow rate and, to return to steady state accumulation phase conditions as rapidly as possible, the collect and plasma pumps may be temporarily halted.

Dynamic control over accumulation volume and spillover volume can be utilized if sensors are located at the barrier and/or at the collect line.

An alternative technique for raising the interface during the spillover phase is to increase the exit flow of plasma which can be accomplished easily by increasing the plasma pump speed.

BRIEF DESCRIPTION OF THE DRAWING

The above-mentioned and other features and objects of the invention and the manner of attaining them will become more apparent and the invention itself will best be understood by reference to the following description of embodiments of the invention taken in conjunction with the accompanying drawing, a brief description of which follows.

FIG. 4A shows the stratification present after a pool of sparse component is built during the accumulation phase. FIG. 4B shows the stratification just prior to spillover and FIG. 4C shows the stratification at the beginning of spillover.

DETAILED DESCRIPTION

Figure 1:
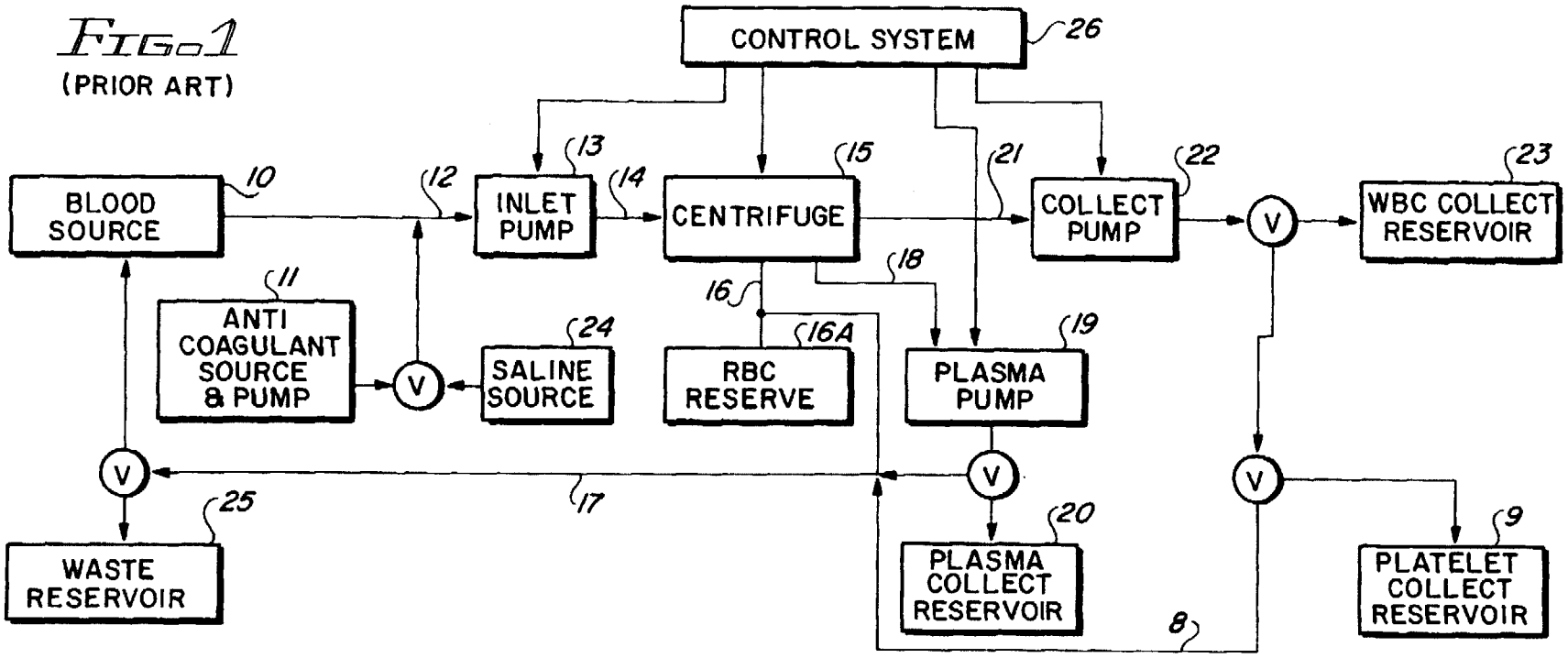
FIG. 1 (PRIOR ART)
FIG. 1 is a block diagram of an MNC collection system for utilizing the current invention.

Referring now to the drawings, like numbers indicate like features, and a reference number appearing in more than one figure refers to the same element.

FIG. 1 is a block diagram of a centrifuge system for collecting blood components. Such a system is the COBE® "SPECTRA"™ which is produced and sold by the assignee of the invention. Blood source 10 may be a donor or a patient from whom whole blood is removed through a needle, usually positioned in one of the donor's or patient's arms. Alternatively, a catheter may be positioned in one of the large veins. The blood source 10 may also be previously collected whole blood or bone marrow made available to the system of FIG. 1 from a reservoir. If blood or bone marrow has been previously collected, an anticoagulant (AC) solution will have already been added to the whole blood or marrow at the time it was collected and, consequently, additional AC solution may not be needed during the collection procedure. However, if blood is withdrawn directly from a donor or a patient, an AC source 11 is used to provide the required amount of AC solution to the whole blood. Entry of AC solution is preferably positioned in close proximity to the needle or catheter. In the following discussion, an MNC collection procedure is described using whole blood as the source of MNCs. The description is also accurate when bone marrow is used.

Whole blood is drawn from the source 10 through inlet line 12 by an inlet pump 13 and passed through line 14 into centrifugal apparatus 15. Red blood cells, along with a reduced fraction of plasma, are removed from the centrifuge through outlet line 16 and passed into return line 17 for return to the donor or patient. Plasma is removed through outlet line 18 through a plasma pump 19 and may also be returned to the donor or patient through return line 17. Alternatively, if a portion of the plasma is to be collected, the associated valve 19', directs the fluid into a plasma collect reservoir 20. White blood cells are removed from the centrifuge through outlet line 21 by the collect pump 22. The outlet of collect pump 22 is connected to a WBC collect reservoir 23. During periods when WBCs are not being collected, platelets are removed through line 21 and collect pump 22. A portion of the platelets can be harvested in platelet collect reservoir 9, or, platelets can be returned to the donor through line 8 and line 17.

To prime the system, a saline solution in reservoir 24 may be used. A clamp 24' is opened to allow inlet pump 13 to pump saline solution to the channel and through the various lines within the tubing set of the system prior to beginning the collection procedure. Saline solution may also be used at the end of the procedure to clear blood from the lines. A waste reservoir 25 is included for receiving the saline solution.

Figure 2:
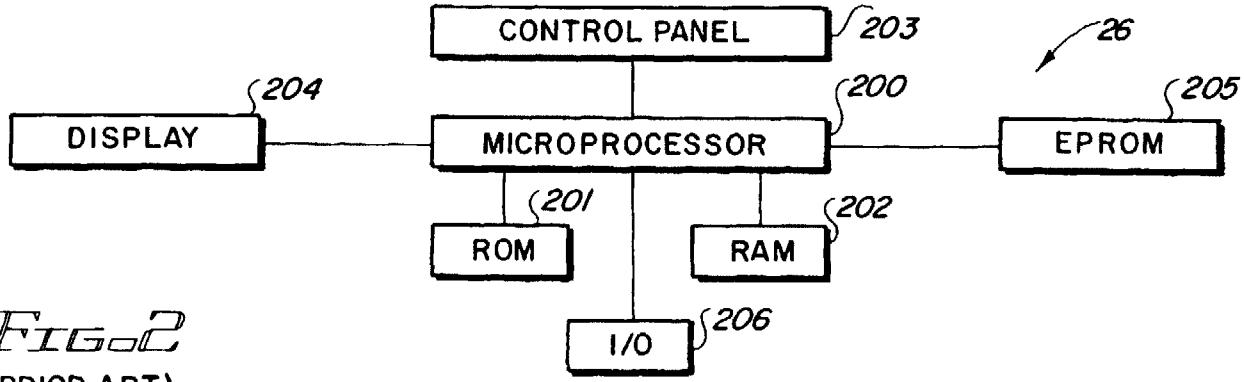
FIG. 2 (PRIOR ART)
FIG. 2 shows components of a control system for use with the collection system of FIG. 1.

The control system 26 controls the various components within the system such as valves, pumps, centrifuge, etc. Any suitable type of control technology may be used, but it is advantageous to use a microprocessor-based system through which system parameters may be easily changed through the flexibility offered by control programs. FIG. 2 illustrates such a system.

FIG. 2 shows a microprocessor 200 connected to a read only memory (ROM) 201, a random access memory (RAM) 202, a control panel 203, a display device 204, and programmable read only memory (PROM) 205. The control panel 203 may contain a keyboard or keypad for changing plasma pump speed or other system parameters. If desired, analog input control devices may be used on the panel together with analog to digital (ADC) converters. The display device 204 may be a monitor separate from the control panel, or it may be incorporated into the panel. The display device may be used to provide system information to an operator during operation of the system to enable manual adjustment of system parameters.

ROM 201 contains initializing programs so that the microprocessor can check the availability of all control components and otherwise ready the control system for performing whatever operations are required of it. RAM 202 is a writable memory into which is placed the control programs for operating the system according to the particular procedure to be performed. RAM 202 provides for a rapid interchange of data with the microprocessor 200. The PROM 205 contains control programs. For example, if an MNC collection is to be performed, a control program for that procedure is contained within PROM 205. The control procedure may be transferred to RAM 202 or it may directly interface with processor 200. Input and output lines 206 from microprocessor 200 lead to control components for the various valves, monitoring devices and pumps within the system. In a control system, such as used on the COBE® "SPECTRA"™, several microprocessor based systems, such as shown in FIG. 2, are used to provide the redundancy needed for reducing the chance of equipment failure so important in medical devices. Control functions are split among the microprocessors, one having primary responsibility for pump control, one with primary responsibility for sensor signal processing, etc.

Figure 3:
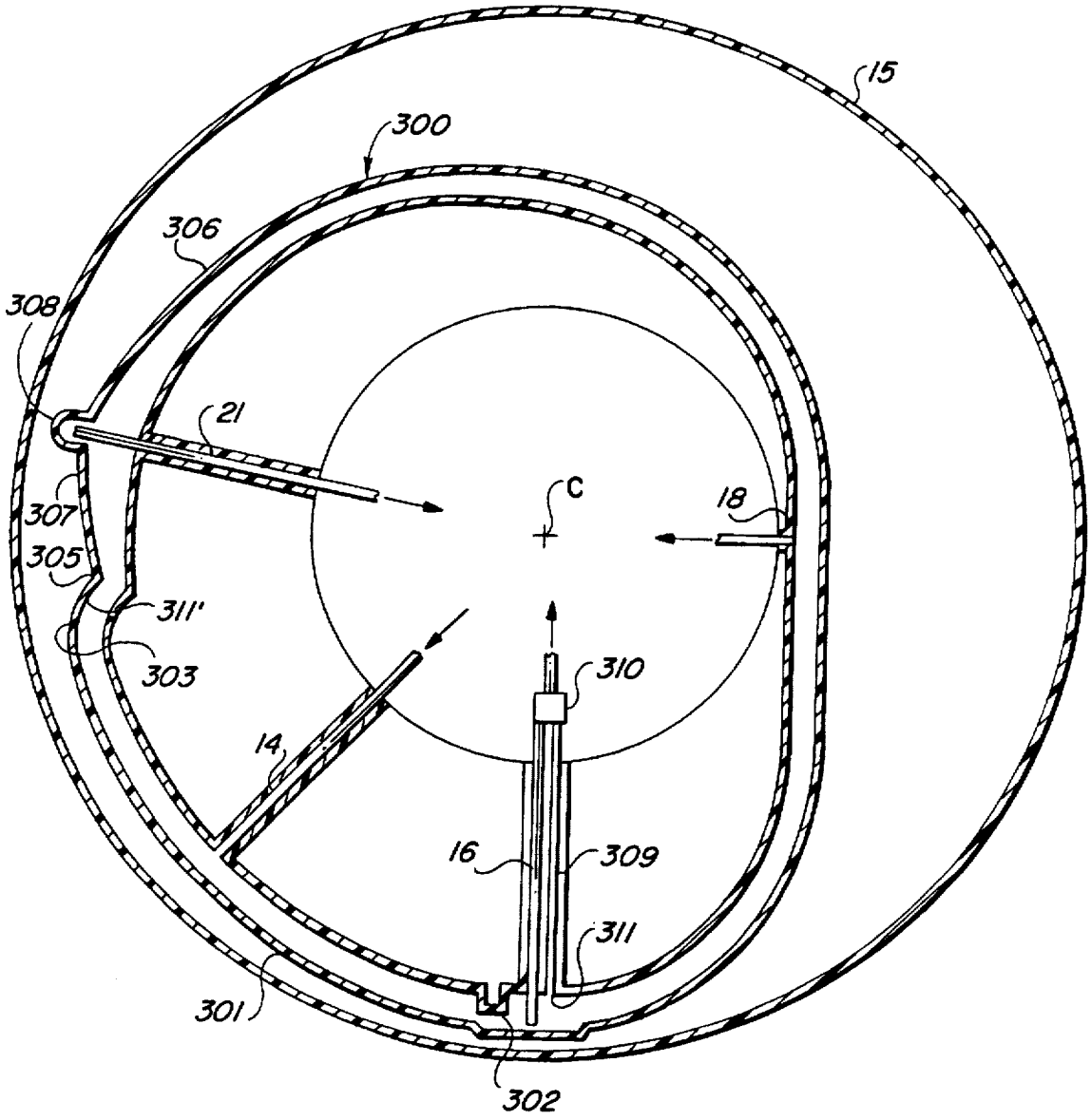
FIG. 3 (PRIOR ART)
FIG. 3 illustrates aspects of a circumferential separation channel for use with the inventive system.

FIG. 3 is a view of the circumferential separation channel used in the COBE® "SPECTRA"™ to separate whole blood into its components for the collection of white blood cells in accordance with this invention. The channel shown in FIG.

3 has previously been used for the collection of platelets and is described in U.S. Pat. No. 4,708,712 incorporated herein by reference. Separation channel 300 is a disposable element which is placed within the centrifuge apparatus 15. Inlet pump 13 supplies whole blood through inlet line 14 to a first stage separation portion 301 of the channel 300. First stage separation portion 301 is that portion of the channel between a dam 302 and a transition portion or barrier portion 303. First stage separation portion 301 decreases slightly in radius from the dam 302 to the barrier portion 303. The radius referred to is the distance of the channel from the center of the centrifuge, C. The barrier portion has a sharply decreasing radius connecting at the barrier top 305 with a° second stage separation portion 306.

Second stage separation portion 306 includes a first portion 307 with an increasing radius outer wall, ending at collection well 308. The end of collect tube 21 is positioned in well 308 and is connected to collect pump 22. The remainder of the second stage separation portion 306 decreases in radius from the collect well 308 to the plasma outlet 18, which is at the smallest radius of any portion of channel 300.

RBC outlet line 16 is positioned within the channel behind the dam 302 at the largest radius of any portion of channel 300. The dam provides a region which can be completely filled by the separated dense component red blood cells, thereby preventing flow of the lighter phase plasma and platelets past it. An interface control positioning line 309 is located near RBC outlet line 16 and joins with line 16 at junction 310.

The interface of the heavier red and white blood cell components and the lighter blood components, plasma and platelets, is generally established at the radius of port 311 by hydraulic control including line 309. The control mechanism is effective in controlling the interface during steady state operation, since if the interface moves radially inwardly, the red cell component begins to flow throughport 311 into tube 309. Flow rate through the control tube 309 is thereby reduced since the red cell component is more viscous than the plasma component. The reduced flow rate causes the plasma component to increase within the channel, thus pushing the interface radially outwardly back to the proper position. Similarly, if the interface moves radially outwardly from port 311, the less viscous plasma component flows through line 309 increasing the flow through the control tube, thus causing the interface to return to the position of port 311.

A feature of the channel 300 is the location of point 311' on the outer wall of channel 300 in the barrier portion 303. Point 311' has the same radius as port 311, thus providing the nominal interface position of the red and white blood cells and the lighter components at the barrier 303. However, because the RBCS must exit the channel through RBC line 16 which is located at the outside edge of the channel and below the interface position, the lighter WBCs are left between the barrier and the dam and do not exit. As a result, a pool of slightly less dense white blood cells, mostly MNCs, form at the barrier 303 and, as the inventors teach herein, can be harvested.

As explained in U.S. Pat. No. 4,708,712, and further explained here, the density of the incoming blood at line 14 into the first stage separation portion 301 is lower than the mean density of the separated components in the region of the inlet, so that the incoming blood is caused to flow clockwise in the direction of the smaller channel radius. Under centrifugal action, the red cells and a portion of the white cells begin to sediment radially outwardly owing to their greater density. As they do, the mean density of that fraction increases so that a clockwise flow of that fraction diminishes and eventually stops. The packed red and white cell fraction then flows counterclockwise along the outer wall of portion 301 toward the dam 302 where they are removed by the RBC outlet 16. The blood components remaining near the barrier 303 in portion 301 after separating out the red and white cells are a portion of the white cells (MNCs), platelets and plasma. Platelets and plasma continue to flow clockwise over top 305 of barrier 303, while the white blood cells (MNCs), which are slightly less dense than the RBCs, collect in a pool behind the barrier. The platelet and plasma mixture, which is much less dense than the RBCs and WBCs, continues to flow clockwise over barrier 303 and through the second stage separation portion 306.

It may be observed from FIG. 3 that the inlet line 14 is a significant distance from barrier 303. Thus, as whole blood enters the channel and begins to move in a clockwise direction, the red blood cells begin to separate and collect along the outer wall. As the mixture moves clockwise, a portion of the less dense white blood cells (MNCs) form on the surface of the red blood cells. As stated above, the RBCs change direction of flow near the barrier 303 and move along the outer wall of the channel toward the RBC exit line 16. The MNC pool formed on the surface of the RBCs, accumulates in a pool at the barrier 303.

There is importance to the location of the MNC pool at a significant distance from the inlet port in order to provide time for the MNCs to separate from the RBCs and thereby form a pool. The preferred channel construction, therefore, is to locate inlet line 14 at a significant distance from barrier 303 as shown in FIG. 3.

In the second stage separation portion 306, the platelet and plasma mixture is subjected to a high centrifugal force, causing the platelets to sediment radially outwardly along the outer wall. Platelets move along the outer wall in the second stage separation portion to the collect well 308. Those platelets that have not been separated prior to reaching well 308 continue to sediment radially outwardly in the decreasing cross-sectional area portion until they reach the outer wall and then reverse their directional flow and slide counter-clockwise down the outer wall into the collection well 308. The platelets are removed from well 308 through operation of collect pump 22 and collect line 21. The remaining plasma with a low platelet concentration continues flowing clockwise. A fraction of the plasma is removed at outlet line 18 and the remaining plasma fills the channel between plasma exit 18 and control port 311. Some plasma exits the channel through the interface positioning outlet control line 309 at port 311, as previously described.

An advantage of the second stage channel construction is the provision of a separate plasma exit line 18 from the collect line 21. The provision of a separate plasma exit enables the minimization of the collect volume and thereby enables a high collect concentration. It also enables high collect concentration regardless of whether the hematocrit is high or low in the inlet line since plasma pump speed can be adjusted to meet the requirements for high collect concentration. This will be explained in more detail below.

The inventors herein provide an important, new understanding in the action of channel 300 in describing the pooling of white blood cells at the barrier 303 and techniques for harvesting that pool.

Figure 4A:
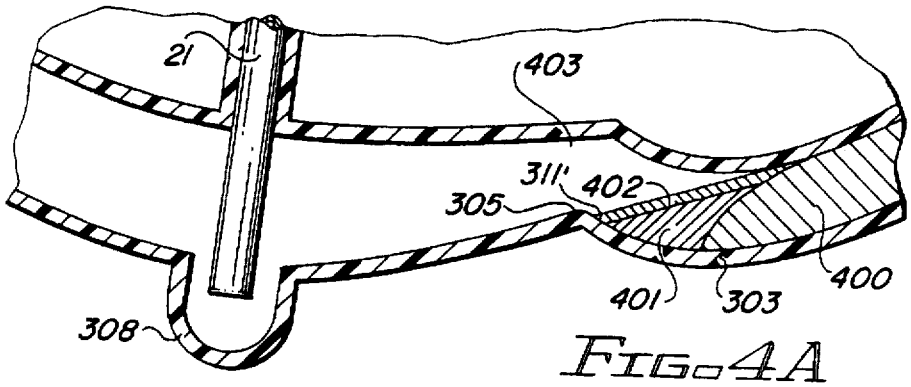
FIGS. 4A–4C are diagrammatic illustrations showing the position of the stratified blood components.
Figure 4B:
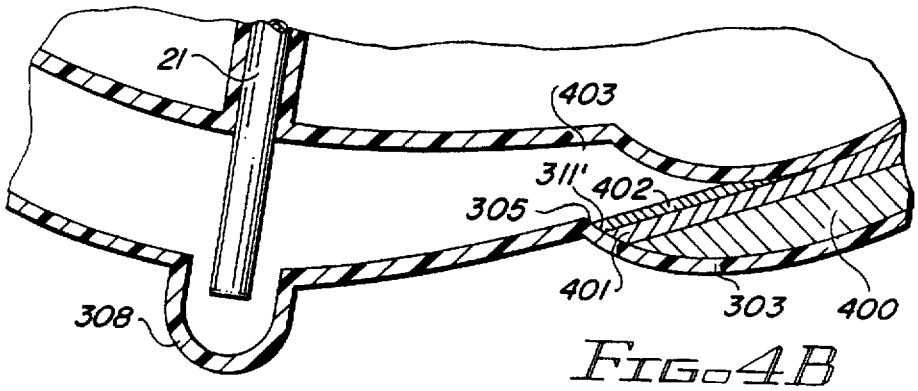
Figure 4C:
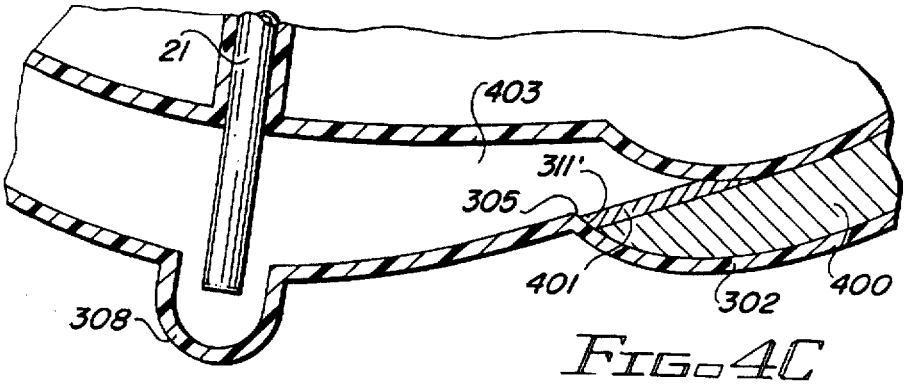

FIGS. 4A–4C are diagrammatic illustrations of the build-up of an MNC pool behind the barrier 303. FIG. 4A illustrates a steady state condition in which the interface between the less dense plasma and platelets component and the more dense RBC and WBC component is held steady and in which MNCs are accumulated in a pool 401. During the accumulation period, platelets are removed from the well 308 through collect line 21. A red blood cell layer 400 is positioned along the outer wall of the channel, with the interface between layer 400 and lighter components generally as shown in FIG. 4A after the formation of pool 401. A pool 401 of white blood cells is formed behind barrier 303 and is a pinkish color as opposed to the deep red of RBC layer 400. A thin, whitish layer 402 which probably contains primarily platelets forms on the surface of the pinkish layer 401, while a yellowish colored platelet rich plasma fills the remainder of the channel and spills over the barrier. As previously described, platelets are collected along the outer wall of the channel and accumulate in the well 308 where they can be harvested through collect line 21 and/or returned to the patient.

FIG. 4A shows that the interface of plasma and platelets with the heavier red and white cells extends, generally, to point 311' on the barrier 303. Because the WBCs are not sufficiently dense to exit at RBC line 16, a pool 401 of WBCs accumulates as a separate pool from the RBCs.

FIG. 4B illustrates the position of layers 400, 401 and 402 when the red blood cell layer 400 is allowed to rise toward causing a spillover condition. FIG. 4C illustrates the start of a spillover of WBCs. Following the spill, the WBCs flow into a well 308 from which they are removed through line 21. Once the desired volume of white blood cells has been collected, the level of the red blood cell layer 400 is allowed to drop to its normal level shown in FIG. 4A so that the pool of white blood cells 401 may form again. Periodically, the RBC level may be allowed to rise creating another spillover and collecting more white blood cells.

Various techniques have been used to control the raising of layer 400 to create the spillover condition. The preferred technique at this time is to stop the flow of whole blood on the inlet line such that flow is reversed in the RBC line. This phenomenon is based on the relationship that the inlet flow to the channel must equal the outlet flow from the channel. The outlet flow is comprised of flow through the plasma line 18, flow through the collect line 21 and, during the accumulation phase, flow through the RBC line 16. Establishment of the plasma pump speed and collect pump speed causes the flows through lines 18 and 21 to remain constant. By reducing the inlet flow below the level of the combined flow in lines 18 and 21, the direction of flow through line 16 is reversed. As a consequence, red blood cells enter the channel 300 through line 16 and raise the level of the interface with dense RBC/plasma solution from beneath the interface surface causing a spillover of the MNC reservoir over the top 305 of barrier 303. FIG. 1 shows an RBC reserve reservoir 16A connected to line 16 that may optionally be used for supplying the reverse flow of RBCs to the channel during the spillover period.

While raising the layer 400 may be accomplished by lowering the speed of the inlet pump, and inducing accumulation of RBCs in the channel through reverse flow in the RBC line 16, the preferred technique is to entirely cease inlet pump operation. In either case, the key is to cause RBCs to accumulate in the channel. These "recirculated" RBCs raise the RBC level from below the surface of the interface thus leaving the MNC pool located at the RBC surface undisturbed. Moreover, as apparent from FIG. 3, the recirculated RBCs enter the channel through line 16 at a significant distance from the MNC pool formed at the barrier 303. That distance also contributes to the purity of the spillover since entry of the RBCs at a significant distance from the location of the pool contributes to leaving the pool undisturbed.

Another less preferred technique that has been used successfully to create a spillover is to continue the inlet pump flow during spillover and to increase the plasma pump flow to a point where the control mechanism at line 309 is starved for plasma. The result is to cause the RBC level to increase, thus causing a spillover. By removing plasma at a faster rate through line 18, the RBC level is raised through the use of blood from the inlet line in which red blood cells are separated and deposited on the top surface of the RBC layer. As the deposited RBCS raise the interface level, the space within the channel through which the plasma moves is decreased resulting in a high velocity, short time period for the inlet blood to travel toward the barrier. The time period may become too short for the red blood cells to be thoroughly separated so that the purity of the spillover is affected.

With the preferred technique of building the interface from below, the purity of the spillover is independent of the speed at which the spillover occurs. Thus, if it is desired to increase spillover speed to reduce the time in which a patient is connected to the machine, that can be accomplished and purity maintained. To increase spillover speed, the plasma and collect pump speeds can be increased during the spillover period together with halting the inlet flow.

With the inlet flow off, the sum of the collect flow and plasma flow equals the rate at which the fluid in the RBC line enters the channel. Only the RBCs in the entering fluid build the level of the interface. Therefore, the rate at which the interface is built is as follows:

$$\text{Interface Build Rate}=(Q_{collect}+Q_{Plasma})\ HCt_{RBC\ Line}$$

The RBC line hematocrit is known from the patient Hct and the pump rates used during the accumulation phase.

Concentration of the collected white blood cells may be adjusted by adjusting the ratio of plasma pump speed to collect pump speed during the spillover period. Once a spillover commences, inlet pump off, the channel is no longer separating RBCs and the exit flow from the channel (collect flow and plasma flow together) equals the inlet flow from the RBC line. However, due to the geometry of the channel, essentially all of the cells flowing out of the channel flow out of the collect line and only plasma flows out of the plasma line. Thus, the cellular concentration of the collected product can be adjusted by adjusting pump speed according to the following relationship.

$$\text{Collect Line Concentration} = \frac{(Q_{Plasma} + Q_{Collect})\ Hct_{RBC\ line}}{Q_{Collect}}$$

From the above relationship, if the plasma pump is off, plasma and cells exit the channel through the collect line and collect line concentration is equal to the hematocrit of the RBC line. If a more diluted product is desired, additional plasma can be added to the collect bag after the spillover is ceased.

If it is desired to increase concentration (thus minimizing the volume in the collect bag), the plasma pump may be turned on to a desired speed to remove some of the plasma that enters the channel with the RBCs. It may be noted that 100% concentration is not possible since the spillover cellular product must be pushed up into the collect bag by plasma. Therefore, some of the plasma will mix with the collected product.

When the desired spill volume is reached, the fastest and most effective way of ending the spillover is to shut off the flow of plasma in lines 18 and 21 and simultaneously to increase the speed of the inlet pump. The effect is to cause plasma to enter the channel and push the interface down. This can be done without stopping the collect pump. However, if the collect pump is stopped the plasma build-up is faster.

In operation, the spill volume can equal the entire reservoir volume of white blood cells collected behind the barrier 303. More likely however, control will be exercised to collect only a percentage of pool 401. If an attempt is made to collect the entire pool, quite a number of red blood cells or polymorphonuclear white blood cells (PMNs) may also be collected since it is those cells that are pushing up the pool 401 to cause the spillover. If the object is efficiency, then a greater amount of the reservoir 401 will be collected on each spillover. However if the interest is purity, then it will be desired to collect a lesser volume on each spillover.

The purity of the collect volume is superior to any known technique of collecting MNCs and may be attributed to the fact that the level of the interface is built from below with reentry into the channel of already separated RBCs from the RBC line at a point significantly removed in distance from the location of the MNC pool. With reference to FIGS. 3 and 4A–4C, the RBC line 16 is located at one end of channel section 301 near dam 302 while the MNC pool is formed at the opposite end of section 301 near barrier 303. If the configuration of channel 300 was such that the RBC line 16 was located near barrier 303, entry of the RBCs into channel 300 through line 16 could cause some contamination of the MNC pool. Moreover, such a close proximity of the RBC line with the barrier would make it more difficult to produce a large MNC pool since the removal of RBCs during the accumulation phase would create enough turbulence in the region of the MNC pool to remove white blood cells with the RBCs. This would lengthen the accumulation phase as well as causing a smaller MNC pool. Moreover, with the interface control mechanism line 309 also located near the barrier the RBC level at the barrier would be more stringently controlled resulting in a smaller MNC pool. With smaller MNC pools more frequent smaller spillover collections are needed resulting in a more lengthy procedure. For these reasons, location of the RBC line and location of the interface control mechanism at a significant distance from the barrier is the preferred channel construction.

It is also possible with this technique to collect the layer 402, which may contain a high proportion of progenitor cells. Research has not yet been conducted to determine the nature of the whitish layer 402. Obviously, from FIGS. 4A–4C, collecting layer 402 requires the collection of only a small fraction of the pool formed at the barrier 303.

Figure 5:
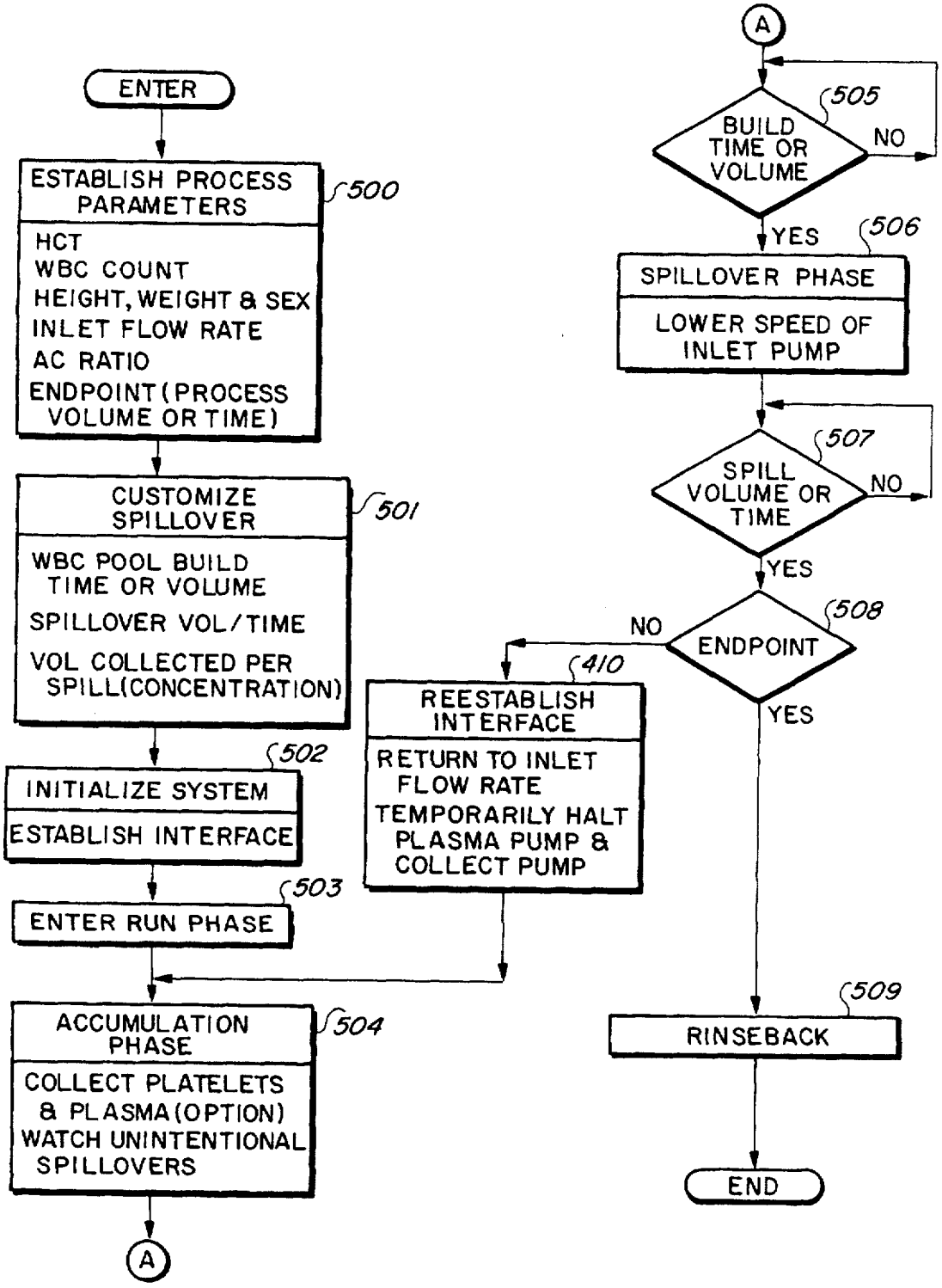
FIG. 5 is a flow chart of the control system of the invention for use with the collection system of FIG. 1.

The manner of achieving the desired results described above is shown in FIG. 5. In operating the centrifuge system of FIG. 1, it is necessary to establish process parameters. Tests are taken of the whole blood to be processed in order to determine the hematocrit (HCT), WBC count and MNC percentage for that blood. Those values, together with the height, weight and sex of the donor or patient, are input to the system by the operator through the control panel 203. FIG. 5 shows these system inputs at step 500. The inlet flow rate is established in accordance with the size of the donor or patient if the blood is being directly withdrawn from a vein. The AC ratio is established according to clinical requirements. The total volume of whole blood to be processed or the time of the procedure are also input to the system through the control panel 203 in accordance with clinical requirements. The speed of the plasma pump is established by the control system as a function of the input flow rate and hematocrit. The speed of the collect pump is based on desired platelet concentration in the collect line. The separation factor which sets the speed of the centrifuge is usually a constant value from procedure to procedure for a particular centrifuge apparatus. Often the centrifuge runs at maximum speed.

In the practice of the inventive process, time must be provided to allow the reservoir 401 to accumulate behind the barrier 303. That time is a function of the MNC count, the inlet flow rate, the barrier geometry and the separation factor. Since the latter two factors are generally constant for a specific device, the WBC pool build time is usually determined as a function of the MNC count and inlet flow rate. In FIG. 5 the establishment of the build time is shown at step 501.

The interface spill volume or time must also be established at step 501. As discussed above spillover occurs by raising the level of red blood cells within the channel and that is accomplished in a preferred embodiment by lowering (or stopping) the speed of the inlet pump. Routine experimentation with the machine enables the establishment of tables within the control system for timing the beginning of a spillover after the inlet pump is turned off or reduced in speed or an optical device positioned at collect line 21 may be used to dynamically indicate when spillover has commenced and to open the collect valve 23'.

If it is desired to raise the RBC level at a slower rate, the inlet pump might be continued at a fractional speed and a table of values established or parameters established for calculating the beginning of the spillover at various fractional speeds. It is also within the operator's control to establish the percentage of the WBC pool that is allowed to spill over. If the operator is concerned with the efficiency of collection, a greater amount of the pool will be spilled over before lowering the RBC interface. If purity of the collection is the primary concern, a smaller percentage of the pool will be collected prior to lowering the RBC level.

A final parameter established at step 501 is the volume collected per spill. As indicated above, the collect pump operates continuously to remove platelets from the well 308 until the spillover begins. At that time, valve 22' is toggled to allow the output of the collect pump to feed into the WBC collect reservoir 23. When the time is reached to lower the RBC level the collect pump may continue to feed plasma into the WBC collect reservoir for a period sufficient to reduce the concentration of white blood cells to a desired level. That parameter is established at step 501.

After the completion of steps 500 and 501, the system of FIG. 1 may be initialized as shown in step 502. Whole blood is introduced into the system and a period of time provided to remove any saline solution which might have been used to prime the system. It is also necessary to establish the interface position properly. Once the system is initialized and stabilized, the run phase is entered at step 503. The run phase is comprised of an accumulation phase in which a pool of white blood cells is allowed to build behind the barrier 303, and a spillover phase in which the interface level is raised to create a spillover condition. Initially the accumulation phase is entered at step 504 during which platelets may be collected in collection reservoir 9, if desired, and plasma may be collected in plasma collect reservoir 20, if desired. One reason for collecting platelets might be to enable the transfusion of platelets, together with bone marrow, after a chemotherapy treatment. It may also be desirable to collect some plasma in order to dilute the white blood cell collection to a desired volume before freezing it.

In the accumulation phase it is also necessary to watch for unintentional spillovers. For healthy donors an unintentional spillover is fairly unlikely, but for patients the possibility of such a spillover is significantly increased. These patients may have already had chemotherapy treatments and the red blood cells may not sediment in the same fashion that a healthy donor's red blood cells would sediment. This phenomenon is manifested by the interface not settling down to its normal position. Unintentional spillovers can be monitored by having an optical view of the collect line or the collect well, either through human observation or through optical componentry, to detect a differentiation in the density of the color of the fluid being collected. If red cells appear in the collect line during the accumulation phase, a degree of opacity in the collect line will result. If that occurs, the plasma or collect pump flow rate can be slowed in order to correct the situation.

If desired, an optical monitoring system may be located on the spinning channel itself viewing the reservoir at the barrier in order to determine when an inadvertent spillover might occur. In that manner, it may be possible to slow the inlet flow rate and the plasma flow rate in order to prevent a spillover from occurring. By slowing the plasma pump, plasma is forced to exit the channel through the red blood cell line, which has the effect of pushing down the red cell interface. One problem of utilizing a higher level of plasma in the channel is that it reduces the WBC reservoir volume. Basically, what is desired is to maximize the plasma flow rate without causing an unintentional spillover.

The accumulation phase continues for the appropriate build time or volume as shown at step 505, after which the spillover phase is entered at step 506. At this time, the speed of the inlet pump is lowered so that the directional flow through the RBC line 16 is reversed. In that manner, the RBC level builds within the channel, thus creating a spillover condition. It should be noted that if desired, an RBC reservoir 16A (FIG. 1) may be connected to line 16 in order to provide a source of red blood cells during the spillover period. The spillover phase continues as shown at step 507 until the spill volume or time has been satisfied. At that point, the system inquires as to whether the endpoint has been reached, i.e., has the process volume or time been reached at which the procedure should be halted. If not, a return is made to the accumulation phase for once again building the WBC pool behind the barrier. In order to re-establish the interface, the RBC level must be lowered at step 510. To accomplish that task, the inlet flow rate is resumed and, if desired, the plasma pump and collect pump may temporarily be halted. The process continues alternating the accumulation phase with the spillover phase until the endpoint (total volume or time) is reached. At that point, at step 508, a branch is made to a rinse back procedure, step 509, to introduce a saline solution to rinse the entire channel tube. This procedure flushes whole blood out of the system and to the patient so that there is very little loss of blood to the patient during the procedure.

Figure 6:
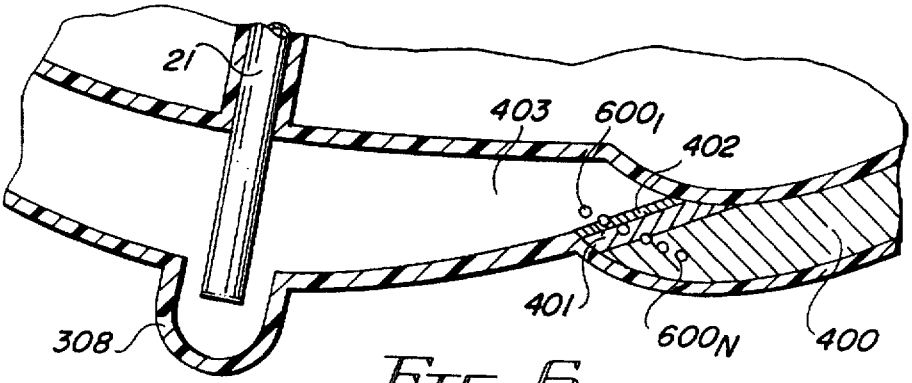
FIG. 6 shows the position of optical sensor ports at the barrier over which spillover occurs.

As mentioned above, an optical monitoring device can be positioned near the barrier to sense the rise of the relatively opaque RBC level. Such a device can also be used to monitor the formation of strata 402 as well as pool 401. FIG. 6 shows the positioning of optical sense ports 600–600N across the barrier region. Such a device provides feedback control information for the avoidance of incidental spillovers, control of the harvesting process to harvest strata 402 only, and control over the spillover to harvest MNC pool 401 without spilling RBCs into the second stage. Such feedback information could be used to replace or supplement calculated periods such as shown at step 502 of FIG. 5.

The preferred embodiment described herein utilizes a hydraulic control mechanism 309 to establish the RBC level at port 311. If desired, optical componentry could be used to establish the RBC level. Such componentry would be similar to the opacity sensing device shown in FIG. 6 but would preferably be a separate device located some distance from the barrier 303 at which the MNC pool is formed. By locating the RBC level control at a distance from the barrier, it is possible to realize the advantages discussed above of a large MNC pool thus minimizing the need for frequent spillovers and minimizing the time upon which a patient is connected to the machine.

As mentioned above, the MNC component of WBCs includes mature cells, such as lymphocytes and also includes precursor cells, such as progenitors and stem cells. Harvesting progenitors and/or stem cells as a separate species is the subject of International Patent Application WO 93/12805 wherein methods are described for culturing such species in a liquid culture medium. The invention described herein may be of value in separating the progenitor cells and/or stem cells from the culture solution. It may also be possible to harvest these cells by skimming just the layer 402 shown in FIGS. 4A–4C. That research has not yet been conducted. It may also be possible to harvest granulocytes by separately collecting the lower portion of the reservoir 401.

In summary, many advantageous structures have been engineered into the inventive apparatus for harvesting white blood cells. Included among these are the location of the inlet port at a significant distance from the barrier at which the MNC pool is formed; the location of the RBC level control mechanism at a significant distance from the barrier; the location of the RBC exit line at a significant distance from the barrier; the raising of the RBC level to harvest the MNC pool by building the RBC layer from below the interface; the reversal of flow in the RBC line during spillover to accomplish the raising of the interface level; the provision of a well in which the MNCs are collected for removal by the collect line and collect pump; the provision of a separate plasma exit line from the collect line; the ability to collect platelets and/or plasma as well as WBCs during the same procedure; control mechanisms which utilize the structure to gain high purity collect fluids independent of spillover speed; control over the interface build up; control over the concentration of the collect fluid; and control of the time needed for the procedure in order to minimize patient time on the machine.

While the invention has been described above with respect to specific embodiments, it will be understood by those skilled in the art that various changes in form and details may be made therein without departing from the spirit and scope of the invention. Some of these changes have been described above. For example, instead of lowering the speed of the inlet pump, as shown at step 506 of FIG. 5, the speed of the plasma pump might be increased. Basically, the mechanism is to raise the level of the red blood cells within the channel and that can be done through alteration of various process parameters. Also, a valve could be placed in the inlet line to divert the inlet fluid. In that manner, inlet flow is halted without stopping or slowing the inlet pump. Basically, an important aspect of the invention calls for raising the level of the interface by slowing or reversing the flow in the RBC line, and that result can be obtained in many suitable ways obvious to a person of skill in the art. As noted above, monitoring devices may be used to discern build up of the WBC pool, rather than relying on previously calculated build time periods. Similarly, the spillover period may be monitored through the use of optical or other types of monitoring devices. Control over the process is illustrated as provided by a programmed microprocessor. Such control could also be provided by any number of known control technologies. The invention has been illustrated with the description of harvesting MNCs from whole blood or marrow. The invention applies also to harvesting other sparse components in blood, and, in general, to any sparse component which can be collected between more dense and less dense fluid components in a centrifuged liquid. These and other variations are within the spirit and scope of the invention which receives definition in the following claims.

What is claimed is:

1. The centrifugal method of harvesting a sparse component within a liquid where the sparse component is stratified in a first layer located between a second layer of more dense component and a third layer of less dense component, an interface formed at the junction of said third layer with the layers of more dense components, said method comprising the steps of:

providing a separation vessel for use with centrifuge apparatus, said vessel having a barrier located therein, an inlet line for delivering said liquid to said vessel, a collect line for collecting said sparse component, a first exit line for exiting said more dense component, and a second exit line for exiting said less dense component;

providing a control system so that said apparatus can be operated to collect said sparse component, including an accumulation phase and a spillover phase;

during the accumulation phase, providing for establishing the level of said interface in a steady state condition at said barrier to allow said sparse component to form a pool while said less dense component flows past said barrier to said second exit line and said more dense component exits said vessel through said first exit line;

during the spillover phase, providing for raising the level of said interface from below the level of said interface to cause said pool to spill past said barrier to said collect line for harvesting said sparse component.

2. The method of claim 1 wherein the step of raising the level of said interface is accomplished by halting the delivery of liquid through said inlet line to reverse the flow of said more dense component in said first exit line and wherein a port for said first exit line is provided in said vessel below the level of said interface.

3. The method of claim 2 wherein the step of raising the level of said interface includes adding said more dense component to said vessel at a significant distance from said barrier to minimize disturbance of said pool.

4. The method of claim 3 wherein the step of establishing the level of said interface in a steady state condition is accomplished by monitoring the level of said interface at a significant distance from said barrier to maintain the level of said more dense component at the monitoring location and allowing the formation of a pool of said sparse component at said barrier.

5. The method of claim 4 wherein said pool is accumulated by locating said inlet line at a significant distance from said barrier wherein said sparse component is separated from said liquid by centrifugal action by the time the liquid flow reaches the location of said barrier.

6. The method of claim 5 wherein said liquid is whole blood, said sparse component is essentially white blood cells, said less dense component is essentially plasma, and said more dense component is essentially red blood cells.

7. The method of claim 6 further including the step of adjusting the concentration of the collected sparse component according to the relation:

$$\text{Collect Line Concentration} = \frac{(Q_{plasma} + Q_{collect})\, Hct_{RBC\ Line}}{Q_{collect}}$$

where $Q_{plasma}$ is the flow rate through the second exit line, $Q_{collect}$ is the flow rate through the collect line, and $Hct_{RBC\ Line}$ is the hematocrit in the first exit line.

8. The method of claim 7 wherein the rate at which the interface is raised is controlled according to the relation:

$$\text{Interface Build Rate} = (Q_{collect} + Q_{plasma})\, Hct_{RBC\ Line}.$$

9. The method of claim 8 further including the steps of at the conclusion of the spillover phase, providing a system for lowering the level of said interface toward said steady state condition; and providing a system for repeating the accumulation phase and spillover phase a plurality of times until a desired volume of sparse component is collected.

10. The method of claim 1 further including the steps of at the conclusion of the spillover phase, providing a system for lowering the level of said interface toward said steady state condition; and providing a system for repeating the accumulation phase and spillover phase a plurality of times until a desired volume of sparse component is collected.

11. The method of claim 1 wherein the step of raising the level of said interface includes adding said more dense component to said vessel at a significant distance from said barrier to minimize disturbance of said pool.

12. The method of claim 1 wherein the step of establishing the level of said interface in a steady state condition is accomplished by monitoring the level of said interface at a significant distance from said barrier to maintain the level of said more dense component at the monitoring location and allowing the formation of a pool of said sparse component at said barrier.

13. The method of claim 1 wherein said pool is accumulated by locating said inlet line at a significant distance from said barrier wherein said sparse component is separated from said liquid by centrifugal action by the time the liquid flow reaches the location of said barrier.

14. The method of claim 1 wherein said liquid is whole blood, said sparse component is essentially white blood cells, said less dense component is essentially plasma, and said more dense component is essentially red blood cells.

15. The method of claim 14 further including the step of adjusting the concentration of the collected sparse component according to the relation:

$$\text{Collect Line Concentration} = \frac{(Q_{plasma} + Q_{collect})\, Hct_{RBC\ Line}}{Q_{collect}}$$

where $Q_{plasma}$ is the flow rate through the second exit line, $Q_{collect}$ is the flow rate through the collect line, and $Hct_{RBC\ Line}$ is the hematocrit in the first exit line.

* * * * *